US011181341B2

(12) United States Patent
Weinland

(10) Patent No.: US 11,181,341 B2
(45) Date of Patent: Nov. 23, 2021

(54) SIGHT DEVICE FOR A FIREARM, IN PARTICULAR FOR A HANDGUN

(71) Applicant: Thomas Weinland, Hamburg (DE)

(72) Inventor: Thomas Weinland, Hamburg (DE)

( * ) Notice: Subject to any disclaimer, the term of this patent is extended or adjusted under 35 U.S.C. 154(b) by 0 days.

(21) Appl. No.: 17/253,174

(22) PCT Filed: Jun. 6, 2019

(86) PCT No.: PCT/EP2019/064855
§ 371 (c)(1),
(2) Date: Dec. 17, 2020

(87) PCT Pub. No.: WO2019/243076
PCT Pub. Date: Dec. 26, 2019

(65) Prior Publication Data

US 2021/0270566 A1 Sep. 2, 2021

(30) Foreign Application Priority Data

Jun. 18, 2018 (DE) ..... 202018103406.5

(51) Int. Cl.
*F41G 1/24* (2006.01)
*F41G 1/26* (2006.01)

(52) U.S. Cl.
CPC *F41G 1/24* (2013.01); *F41G 1/26* (2013.01)

(58) Field of Classification Search
CPC ..... F41G 1/24; F41G 1/06; F41G 1/10; F41G 1/16; F41G 1/17; F41G 1/18; F41G 1/20; F41G 1/22; F41G 1/26; F41G 1/28
USPC ..... 42/133, 147, 148, 138
See application file for complete search history.

(56) References Cited

U.S. PATENT DOCUMENTS

| | | | | |
|---|---|---|---|---|
| 1,338,121 | A | 4/1920 | Burton | |
| 2,593,870 | A | 4/1952 | Ganzhorn | |
| 4,388,772 | A * | 6/1983 | Maes | F41G 1/16 42/135 |
| 4,606,131 | A | 8/1986 | Domian | |
| 7,526,890 | B1 * | 5/2009 | Keng | F41G 1/18 42/111 |
| 9,285,186 | B1 | 3/2016 | Di Veroli et al. | |
| 9,683,811 | B1 | 6/2017 | Warensford | |

(Continued)

FOREIGN PATENT DOCUMENTS

| | | |
|---|---|---|
| DE | 102004063983 | 7/2006 |
| DE | 202011107430 | 12/2011 |

*Primary Examiner* — John Cooper
(74) *Attorney, Agent, or Firm* — Sand, Sebolt & Wernow Co., LPA

(57) ABSTRACT

A sight device for a firearm having a base, a sight arm, a rear sight slide, and at least one rear sight piece having a rear sight. The sight arm engages the base and is pivotable in a pivot direction relative thereto about a pivot axis. The rear sight slide, arranged proximate a free end of the sight arm, is displaceable relative to the sight axis and the pivot direction relative to the sight arm, and is fixed on the sight arm in an adjusted setting position. The rear sight slide includes a receptacle with retaining structures for removably engaging the rear sight piece. A latch section of a spring-loaded latch piece on the rear sight slide engages in a latch receiver on the rear sight piece when the rear sight piece is inserted into the receptacle and holds the rear sight piece in a fixed position.

12 Claims, 3 Drawing Sheets

(56) References Cited

U.S. PATENT DOCUMENTS

| | | | | |
|---|---|---|---|---|
| 2007/0199227 | A1* | 8/2007 | Ertl | F41G 1/10 42/137 |
| 2007/0234625 | A1 | 10/2007 | Kidd | |
| 2008/0092424 | A1 | 4/2008 | Keng | |
| 2014/0298703 | A1 | 10/2014 | Gale et al. | |
| 2015/0198415 | A1 | 7/2015 | Campean | |
| 2015/0198421 | A1* | 7/2015 | Crispin | F41G 11/007 42/126 |
| 2015/0285590 | A1* | 10/2015 | Law | F41G 1/16 42/111 |
| 2016/0091280 | A1* | 3/2016 | Rozic | F41G 1/26 42/111 |
| 2016/0223291 | A1 | 8/2016 | Wolf | |
| 2020/0116456 | A1* | 4/2020 | Pniel | F41G 1/16 |

* cited by examiner

SIGHT DEVICE FOR A FIREARM, IN PARTICULAR FOR A HANDGUN

TECHNICAL FIELD

The invention relates to a sight device for a firearm, in particular a handgun. In particular, the invention relates to a rear sight device, as part of an aggregate sight of a firearm, which, in addition to the rear sight device, also includes a front-sight element. Such a front-sight element may, but need not be integrated into a sight device, such as the one addressed by the invention.

BACKGROUND

Background Information

Firearms, especially those intended for precision shooting (i.e., not point shooting), are equipped with a sight device for aiming at a target. In addition to sighting optics, such as telescopic sights, traditional sights are still known, in which the target is aimed at via the rear sight and the front sight, which are brought into alignment and overlap along a sight axis, in order for the shot to hit the target accordingly. Similar firearms, e.g., long guns, but in particular also handguns, such as pistols or revolvers, are widely used in sport shooting, although not only there. They are also used in hunting, and also as service weapons for armed units, e.g., security services, police, or the army.

Particularly in the field of sport shooting, different competitive disciplines are represented, in which, for example, as regards pistol shooting, different types of sights are permitted or prescribed, whereby the differences primarily relate to different types of sights. For example, in certain competitive disciplines only a round rear sight, or a rectangular rear sight, or a V rear sight are admissible, but not additional means arranged in the vicinity of the rear sight, such as colored light guide rods to the right and left of the rear sight in order to facilitate sighting in low light. In other competitive disciplines, however, such additional target supports, e.g., the aforementioned light guide rods, are permitted. Accordingly, sports shooters participating in different competitive disciplines use different sights. Some shooters use entirely different weapons, each equipped with different sight devices, e.g., using a first handgun equipped with a first sight device, e.g., a pistol, for one competitive discipline, and a second handgun, e.g., a pistol equipped with a second sight device, for other competitive disciplines. Often, however, sport shooters prefer to compete in different disciplines using the very same weapon, which fits well in the hand, and which they handle well and safely, and with which they can shoot accurately. Accordingly, they use weapons, which are equipped with interchangeable sights, in particular rear sights, allowing them to be adapted to the respective competitive disciplines. However, this approach is time-consuming, in that the replacement of a complete sight device can only be done with the aid of tools, sometimes even special tools, whereby, after replacing the sight device, the shooter must in addition first reconnect the weapon in order to readjust the sight device in order to attain a good point of impact.

Accordingly, there is a general need to simplify re-equipping of the sight, in particular by interchangeably arranging and affixing a rear sight blade or rear sight piece on a sight device comprising the rear sight. Such a solution is disclosed in DE 20 2011 107 430 U1. It shows a sight device, more specifically a rear sight device having a rear sight blade (rear sight piece), which is detachably fixed to a sight arm, and which can be replaced, e.g., in order to connect different types of rear sights to the sight device, whereby they may be integrated therein. In the solution shown here, the rear sight blade is inserted laterally, transversely to a sight axis, into a dovetail-groove receiver provided on a rear end of the employed sight arm, and is affixed to a slide by a conical, spring-loaded locking pin. This allows the rear sight blade to be displaced in the dovetail guide by adjusting the position of the slide in order to adjust the lateral point of impact.

In principle, a sight device and a replaceable rear sight blade disclosed in DE 20 2011 107 430 U1 already allow for integrating different types of rear sights in the sights of a firearm without the need to replace a complete sight device, i.e., by simply replacing the rear sight blade. However, replacing the rear sight blade is mechanically complicated. To replace the rear sight blade, the slide must be released from the sight arm in order to remove the rear sight blade from the dovetail guide, thus releasing it from the locking pin. A new rear sight blade can then be fitted and thrust back into the guide. Subsequently, however, the weapon needs to be zeroed in again, in that the lateral position of the rear sight blade, and thus the rear sight, and hence the point of impact of the weapon is not retained, when replacing the rear sight blade. Furthermore, lateral insertion of the rear sight blade, as required in DE 20 2011 107 430 U1, is not readily feasible, in particular with rear sight blades or rear sight pieces, which, in addition to the rear sight opening, contain further attachments, such as light guide rods extended in the direction of the axis of sight in order to improve the sight properties and visibility of the rear sight in poor lighting conditions.

SUMMARY

The object of the invention is to remedy the above, in that, in particular, a sight device with a replaceable rear sight piece is to be provided, which allows for exchanging the rear sight piece without changing the lateral point of impact of the firearm equipped with the sight device.

This object is achieved by a sight device with the features of a base, a sight arm, a rear sight slide, and at least one rear sight piece having a rear sight, wherein the sight arm is fixed to the base in order to be pivotable in a pivoting direction relative to the base about a pivot axis extending transversely, in particular perpendicularly, to a sight axis, wherein the rear sight slide is arranged on the sight arm in the vicinity of a free end of the sight arm, and displaceable transversely, in particular perpendicularly, to the sight axis, as well as transversely, in particular perpendicularly, to the pivot direction relative to the sight arm for an adjustment position, and is fixable on the sight arm in a set adjustment position, wherein the at least one rear sight piece may be detachably fixed on the rear sight slide, and in a defined position relative to the rear sight slide on the latter, wherein the rear sight slide on an upper side has a receiver for the rear sight piece, which receiver is open toward an end face of the free end of the sight arm, and has retaining structures into which the rear sight piece may be inserted in a direction parallel to the sight axis, and in which the rear sight piece is held in a fixed position on the rear sight piece in the pivot direction and in a direction transverse to the pivot direction, and transverse to the sight axis due to the interaction of the retaining structures with matching structures, and wherein a spring-loaded latch piece, which is displaceable in the pivot direction is provided on the rear sight slide, which latch piece engages with a locking section in a locking receiver on the rear sight piece, when the rear sight piece is inserted into the receiver, wherein the rear sight piece is held fixed in position in a direction parallel to the sight axis, when the locking section engages in the locking receiver. Advantageous developments are that the retaining structures on the rear sight slide may be formed by two dovetail grooves, which run parallel to the sight axis and interact with dovetail projections formed on the rear sight piece as a matching structure. Furthermore, the latch piece may be arranged in a latch receiver formed in the rear sight slide, and may be biased by a spring in the direction of the upper side of the rear sight slide into a locking position. The latch receiver may be formed in the rear sight slide, such that the latch piece inserted therein may be accessible only via an opening of the latch receiver on the upper side of the rear sight slide, and in that the rear sight piece has an opening through which the latch receiver and the latch piece arranged therein may be accessible, when the rear sight piece is affixed on the rear sight slide. Additionally, a plane end face may be formed at the free end of the sighting arm, against which end face, a level bearing surface of the rear sight slide may rest and along which the bearing surface of the rear sight slide may slide, when the rear sight slide is displaced relative to the sighting arm in order to set an adjustment position, wherein the end surface in the vicinity of the receptacles may project beyond the contact surface, such that it forms a stop opposite the side, on which the receptacle is open for insertion of the rear sight piece, and limits the insertion of the rear sight piece. Furthermore, the rear sight slide may be displaceable relative to the sight arm by means of a set screw and may be affixable in an adjustment position.

According to the invention, the novel sight device for a firearm, being particularly suitable for handguns, has a base, a sight arm, a rear sight slide, and at least one rear sight piece comprising a rear sight. Here, the sight arm is affixed to the base, whereby it is pivotable in a direction relative to the base about a pivot axis extending transversely, in particular perpendicularly, to a sight axis. The sight axis is the aforementioned axis along which, the rear sight and front sight are brought into alignment during shooting and aligned with the target and the intended point of impact. By pivoting the sight arm relative to the base, an elevation point of impact is set in a per-se known manner. Hence, the sight arm is alterable in a pivoted position and lockable relative to the base so as to adjust the elevation point of impact and allow the weapon to be fired accordingly. Although the pivot movement of the sight arm follows a circular path, only small pivoting travels are required for the sight adjustment, i.e., the adjustment of the position of the elevation impact point, such that the pivot direction is approximately straight. Accordingly, the pivot direction is also understood as a straight-line direction (strictly speaking, corresponding to a tangent to a circular path section defined by the movement of a point of the sight arm, when pivoting the sight arm.

Moreover, the invention provides that the rear sight slide is arranged on the sight arm in the vicinity of a free end of the sight arm, and transversely, in particular perpendicularly displaceable relative to the sight axis, and also transversely, in particular perpendicularly to the pivoting direction relative to the sight arm with respect to an adjustment position, and can be affixed on the sight arm in a set adjustment position. Such adjustability in the specified direction is used to adjust the point of impact in the lateral direction.

Furthermore, the at least one rear sight piece is releasably attachable on the rear sight slide, and attachable on the rear sight slide in a defined position relative to the rear sight slide. In general, this ensures interchangeability of the rear sight piece, such that, in particular, different and various rear sight pieces may be affixed to the rear sight slide for replacement of the corresponding rear-sight form or rear sight device as needed by the user, e.g., for different competitive sport-shooting disciplines. Here, the invention further provides for the rear sight slide to have, on an upper side, a receiver for the rear sight piece, which receiver is open toward a front side of the free end of the sight arm, and has retaining structures, into which receiver the rear sight piece can be inserted in a direction parallel to the sight axis, and in which receiver the rear sight piece is held in a fixed position in the pivoting direction and in a direction, which is transverse to the pivoting direction, and transverse to the sight axis by the interaction of the retaining structures with matching structures on the rear sight piece. Unlike the sight device according to DE 20 2011 107 430 U1, the receiver for the rear sight piece is not formed on a front side of the sight arm, and the rear sight piece need not be laterally inserted into the receiver, i.e., in the direction of adjustment in order to adjust the lateral point of impact position. Instead, the rear sight piece is inserted in the direction of the sight axis into the receiver on the rear sight slide and affixed there. In particular, this action also dissociates the fixation of the rear sight piece on the rear sight slide from an adjustment of the position of the rear sight slide relative to the sight arm in order to adjust the lateral point of impact position, such that, in contrast to the sight device according to DE 20 2011 107 430 U1, a sight adjustment relative to the lateral point of the impact position can be retained, when changing the rear sight piece.

Furthermore, the invention provides that a spring-loaded latch piece, which is displaceable in the pivoting direction, is provided on the rear sight slide, which latch piece engages with a latch section in a latch receiver on the rear sight piece when the rear sight piece is inserted in the receiver, wherein the rear sight piece is held affixed in position in a direction parallel to the sight axis, when the latch section snaps into the latch receiver. Such a latch piece thus serves to affix the rear sight piece in the still remaining spatial direction, i.e., in the direction of the sight axis. The latch piece thus completely secures the rear sight piece in its position, which is reached by thrusting it into the receiver, such that it is held in a fixed position on the rear sight slide, in a form-fitting manner. The rear sight is then also not replaceable in its position, when using the firearm, whereby the point of impact remains the same even after firing several shots, and even after the otherwise usual handling of the firearm (transport, storage, etc.). However, the latch piece may, in particular, be easily moveable, e.g., using a tool, or even manually, in order to quickly replace the rear sight piece. In order to prevent the latch piece from unintentionally detaching and thereby accidentally losing the rear sight piece, the latch piece may additionally be provided with a locking mechanism, e.g., using a locking screw, or the like, inserted into a through-hole passing through the latch piece into the rear sight slide.

From the above description and illustration, it will be apparent to those skilled in the art that the sight device designed in a novel way according to the invention allows for easy replacement of entirely different rear sights in an existing sight device, which is kept in place on the firearm. In particular, such a replacement is possible without adjusting the lateral point of impact of the weapon, when replacing the rear sight piece, such that time-consuming zeroing-in of the weapon after replacing the rear sight piece is not needed. At the most, a test shot is required to check the point of impact. Furthermore, the sight device according to the invention also makes it easy to use rear sight pieces, which have a greater extension in the direction of the sight axis, or parallel thereto, e.g., rear sight pieces with light guide rods, or the like, arranged on the right and left of the rear sight opening. In this regard, the sight device according to the invention offers a simple and quick exchange option for different rear sight pieces, including the use of completely differently formed rear sight pieces for different competitive sport-shooting disciplines, or other purposes.

An advantageous development of the invention provides for the retaining structures on the rear sight slide to be formed by two dovetail grooves extending parallel to the sight axis, whereby these interact with dovetail projections formed on the rear sight piece as matching structures. Such a design represents a particularly simple implementation of a guide for inserting the rear sight piece into the receiver, which similarly allows the rear sight piece to be held securely and in the correct position in the receiver in two spatial directions.

Advantageously, it may further be provided in the sight device according to the invention that the latch piece is arranged in a latch receiver formed in the rear sight slide and biased by a spring toward the upper side of the rear sight slide into a locking position. A section of the latch piece will then engage the rear sight piece on a section facing the top of the rear sight slide, on or in a recess or other matching part provided therein, in order to realize the locking of the rear sight piece in a fixed position on the rear sight slide. In principle, the latch receiver can be arranged at any position on the rear sight slide. It suffices to ensure that the bolt securely locks the rear sight, when being placed in the intended position on the rear sight slide. For example, the latch receiver may be located, such that it is accessible from a rear section of the rear sight slide, whereby the latch piece can be gripped on a rear side, and moved in order to unlock and release the rear sight piece.

A preferred development, however, may in particular provide that the receiver in the rear sight slide is formed, such that the latch piece inserted therein is accessible only via an opening of the latch receiver on the upper side of the rear sight slide, and such that the rear sight slide has an opening through which, the latch receiver and the latch piece arranged therein are accessible, when the rear sight slide is affixed to the rear sight slide. The result of this embodiment is that the latch piece is largely protected and shielded from external influences. Thus, it can be avoided that the latch piece is unintentionally shifted into an unlocking position, e.g., by accidentally striking an obstacle, such that the rear sight blade detaches from the rear sight slide and becomes dislodged, or even lost. In order to unlock, the latch piece must be gripped with an appropriate arbor or similar tool through the opening in the rear sight piece and the opening on the upper side of the rear sight slide and pressed down against the spring force. Such handling is usually not unintentional.

In addition, this solution does not impair the appearance of the rear sight slide, which together with the attached rear sight piece may have an integral design.

A further advantageous development of the invention can provide that a planar end surface is formed on the free end of the sight arm, against which a planar contact surface of the rear sight slide rests, and along which the contact surface of the rear sight slide slides, when the rear sight slide is displaced relative to the sight arm in order to set an adjustment position, wherein the end surface projects beyond the contact surface in the vicinity of the receiver, such that it forms a stop, which is opposite the side on which the receiver is open for insertion of the rear sight piece, and limits the insertion of the rear sight piece. The end surface thus performs two tasks, first it guides the rear sight slide with the contact surface, when the relative position of the rear sight slide is adjusted relative to the sight arm. Second, it forms a stop for the rear sight piece, when the latter is inserted into the receiver in order to further affix and secure the rear sight piece in the receiver. Such a solution is structurally simple, and can be implemented with relatively few separate parts.

Moreover, an advantageous development of the invention may provide that the rear sight slide is displaceable relative to the sight arm by means of a set screw, and fixable in an adjustment position. Such adjustment options for the adjustment position of the rear sight slide relative to the sight arm substantially corresponds to the adjustment of the lateral point of impact position for per-se known sight devices, which has been amply proven in practice, and which may also be used advantageously for the sight device according to the invention.

As already explained, a particular advantage of the sight device according to the invention is that it may comprise at least two, and possibly more, rear sight pieces, which have differently shaped rear sights. In such an embodiment, the sight device according to the invention is meant to be a type of sighting set, with which different sights can be formed for one and the same firearm, e.g., for use in different competitive sport-shooting disciplines.

A further advantageous development of the invention may provide that it is formed as an interchangeable sight device for fixation on a firearm, in particular a handgun, whereby means are formed at the base for fixation on the firearm. Such means for affixation on the firearm may be, e.g., through-holes, through which screws may be passed, such that the sight device may be screwed tightly, e.g., to a barrel or a breech element of the firearm, wherein corresponding threaded holes are provided in the barrel or breech element, or in another part of the firearm, for inserting the fastening screws. In such a design, the sight device according to the invention may, in particular, also be placed on and attached to existing firearms for the purpose of retrofitting such firearms. However, it is also equally possible to integrate the sight device according to the invention into a firearm, such that the base is firmly connected to the firearm, e.g., integrated into the barrel of the firearm, a breech part, or a housing part.

BRIEF DESCRIPTION OF THE SEVERAL VIEWS OF THE DRAWINGS

From the above general description of the invention, the advantages and features of the sight device according to the invention will already be clear to those skilled in the art. For further illustration, an exemplary embodiment of the invention is, moreover, described below as a possible implementation variant, with reference to the attached drawings. In the drawings.

DETAILED DESCRIPTION

Figure 1:
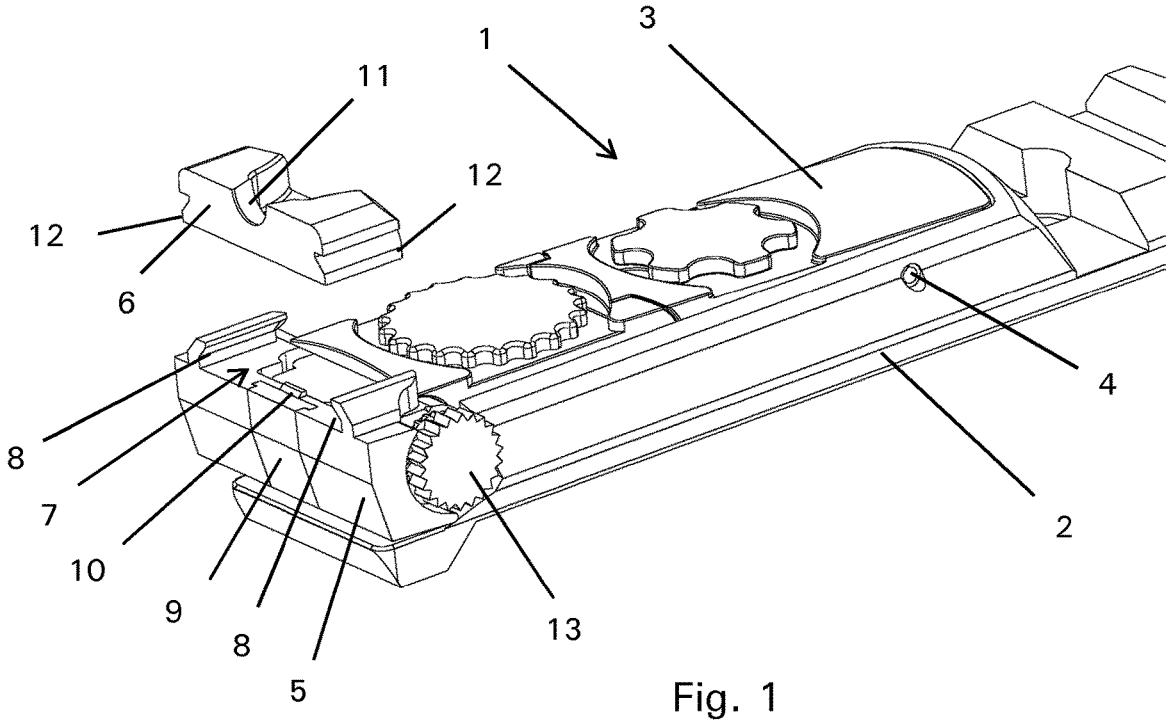
FIG. 1 is a three-dimensional oblique rear view, i.e., a section of a sight device according to the invention in a first exemplary embodiment having a replaceable rear sight piece, which is not attached to the rear sight slide above the installation position.
Figure 2:
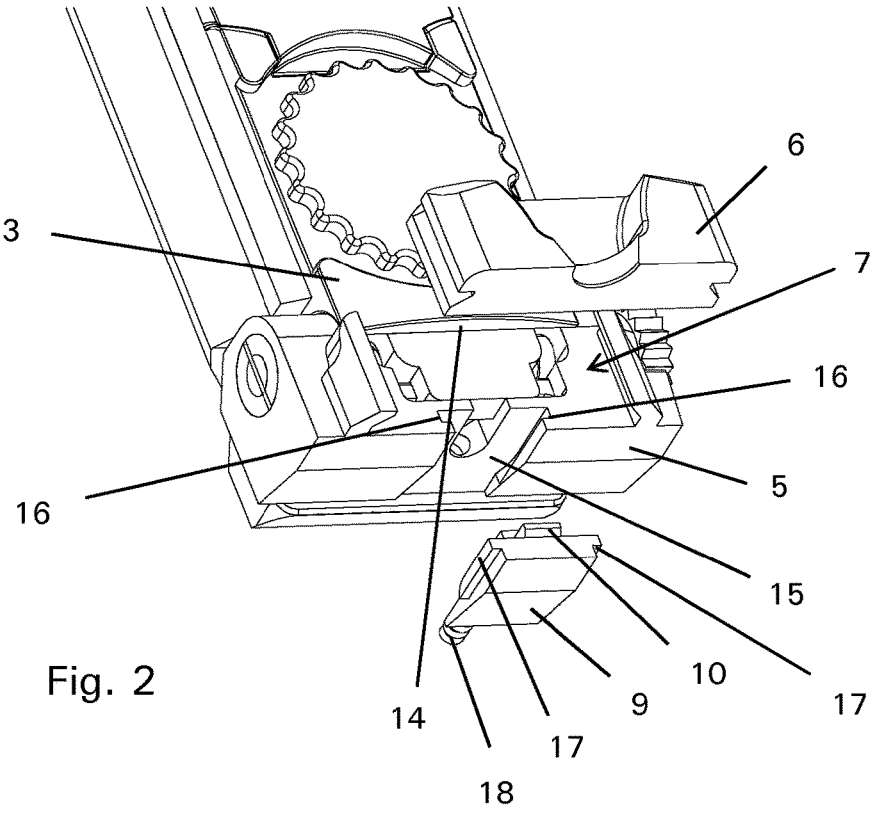
FIG. 2 is a sectional view of the sight device according to FIG. 1, seen obliquely from above, and with the essential parts of the rear sight device in exploded view.
Figure 3:
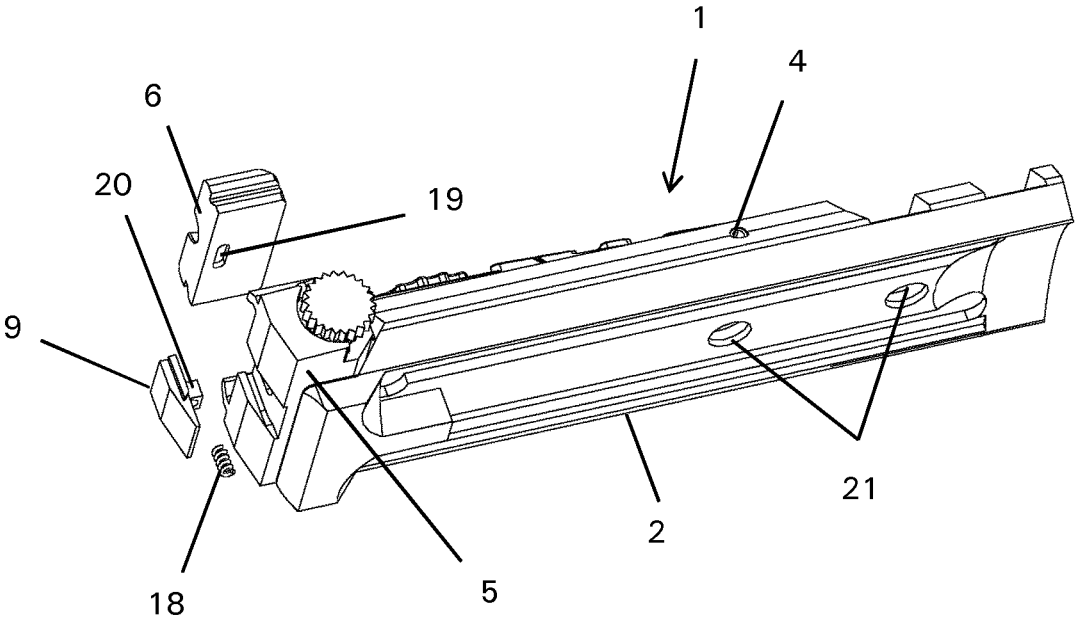
FIG. 3 is a view of the sight device according to FIG. 1 obliquely from below and with the essential parts of the sight device in exploded view.

The figures show two feasible exemplary embodiments for a sight device according to the invention. These are described below with reference to the drawings. It should be noted that in some instances the figures only show sections of the sight devices, i.e., those sections that are essential to the description of the invention. What's more, it bears repeating that the shown exemplary embodiments only represent possible implementation variants of a sight device according to the invention, i.e., there are also other forms of arrangement and variants, in which a sight device according to the invention may be formed. In particular, features that are particular to each of the embodiments shown herein may also be combined and replaced with the other exemplary embodiment. Also, individual features specified in the following description may be used quite generally with embodiments, which are otherwise different from the specific embodiments shown herein and implemented therein, in particular also with such features and general embodiments as were explained in the above general description. In the drawings, the same or similar elements are provided with the same reference numerals.

In FIGS. 1-4, a sight device according to the first exemplary embodiment shown therein is generally designated by reference numeral 1. The sight device 1 is specifically a rear sight device, i.e., does not also contain an integrated front-sight element. The front-sight element for the sight formed with the depicted sight device 1 is mounted on the firearm at a different location and with a separate front sight carrier.

The sight device 1 of this exemplary embodiment comprises, in a manner basically compliant with known comparable sight devices, a base 2 and a sight arm 3 pivotally attached to the base 2 relative to the base 2 about a pivot axis 4 (formed here by a connecting pin). At a free end, which is rearwardly opposite the employed pivot axis 4, a rear sight slide 5 is arranged on the sight arm 3 and is movably fixed transversely to the longitudinal extension of the base 2 and the sight arm 3. A rear sight piece 6 is detachably inserted into a receiver 7 formed on an upper surface of the rear sight slide 5. The rear sight piece has a sight device comprising a sight opening or rear sight 11, through which a sight element is aimed and aligned with the rear sight 11 for sighting a target, wherein a connecting line is drawn between the rear and front-sight element, thus defining a sight axis.

Figure 4:
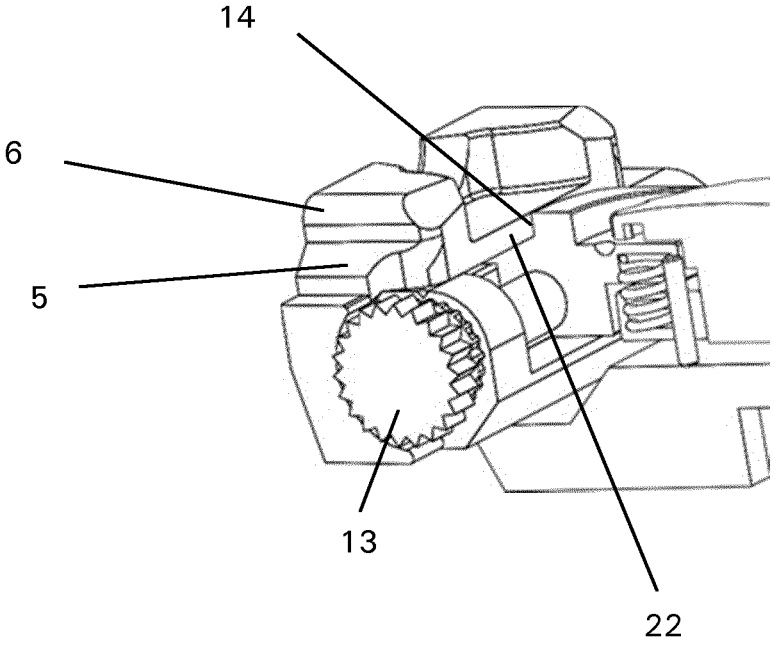
FIG. 4 is a partially cut-away view of the sight device according to FIG. 1, with the rear sight piece attached to the rear sight slide to better display the stop.

The receiver 7 is bounded by lateral webs extending parallel to the sight axis, on which dovetail grooves 8 are formed. Dovetail projections 12, which are formed on the side of the rear sight piece 6, fit snugly into these dovetail grooves. As a result, when the rear sight piece 6 is inserted into receiver 7, such that the dovetail projections 12 engage in the dovetail grooves 8, the rear sight 6 is secured in a direction transverse to the sight axis and substantially parallel to the pivot axis 4, and, moreover, in a further direction transverse to the sight axis, and substantially perpendicular to the pivot axis 4. The latter direction, which is transverse, in particular, perpendicular to the sight axis and perpendicular to the pivoting axis 4, corresponds to a pivoting direction, in which the sight arm 3 may be pivoted for adjustment of the elevation point of impact (in a per-se known and customary manner, and a description of such sight devices is therefore not provided in more detail here). In order to affix the rear sight piece 6 inserted into the receiver 7 also in the direction of the sight axis, a latch piece 9 is provided, and is movably affixed on a rear end face of the rear sight slide 5 in the pivoting direction of the sight arm 3. The latch piece 9 has an upwardly projecting latch section 10, which engages a latch receiver 19 (see FIG. 3) formed on an underside of the latch piece 6 facing the receiver 7 in order to lock the position of the rear sight piece 6. In the shown exemplary embodiment, the latch section 10 has a rearwardly formed run-on bevel, which, in case latch piece 6 is thrust into receiver 7, strikes a front end face 22 (see FIG. 4) of the rear sight piece 6 and, in case the rear sight piece 6 is thrust further forward into the receiver 7, presses the latch piece 9 downward. Whenever the latch section 10 is able to move into the latch receiver 19, the latch piece 9 is pressed upward by the force of a spring 18, which engages a projection 20 of the latch piece 9, whereupon the latch section 10 locks while interacting with the latch receiver 19 of the rear sight piece 6 in a direction of movement in the direction of the sight axis, such that the rear sight piece 6 is held in a completely form-fitting and positionally fixed manner. The latch piece 9 is received and guided in a latch receiver 15 of the rear sight slide 5, in which guide webs 17 formed laterally on the latch piece 9 engage in guide slots 16 arranged laterally on the latch receiver 15. FIG. 4 also shows that the front face 22 of the rear sight piece 6 bears against an end face 14 of the sight arm and is thus held in position in the direction of the sight axis in a form-fitting manner, including at the front.

The rear sight slide 5 is adjusted with a set screw 13 in a direction transverse, in particular perpendicular, to the sight axis and transverse, in particular perpendicular, to the pivoting direction, i.e., substantially parallel to the pivot axis 4, by turning the set screw 13. As can be easily seen, the adjustment of the rear sight piece 15 in this lateral position, which is used to set the lateral point of impact, is independent of the fastening mechanism for the rear sight piece 6. In other words, a rear sight piece 6 may be removed from the rear sight slide 5 (by moving the latch piece 9 downward and away from the receiver 7 against the force of the spring 18, and pulling the thus unlocked rear sight piece 6 backward and out of the receiver 7 in the direction of the sight axis) without any adjustment of the position of the rear sight slide 6 and thus of the lateral point of impact of the firearm equipped with the sight device 1. A rear sight piece 6 may be similarly inserted into the receiver 7 and fixed and locked on the rear sight slide 5 without lateral adjustment of the rear sight slide 5. It is also obvious that, unlike the narrow rear sight blades known from prior art, wide rear sight pieces 6 are used in connection with the sight device 1 according to the invention, and offer extended possibilities for the design of the rear sight 11. For example, light guide rods situated along the direction of the sight axis can be arranged next to the rear sight opening for improved sighting of targets, even in poor light conditions. Similarly designed rear sight pieces 6 can just as easily be attached to the rear sight slide 5 by pushing them into the receiver 7 and locking them there using latch piece 9.

Figure 5:
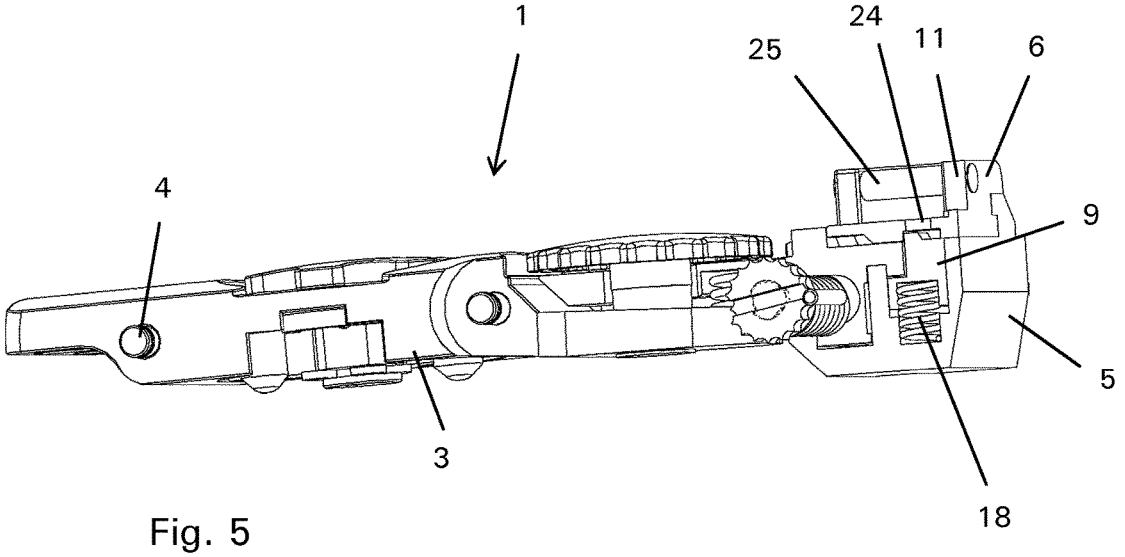
FIG. 5 is a partially sectional view of a sight arm of a sight device according to the invention in a second exemplary embodiment being slightly modified from the first exemplary embodiment.
Figure 6:
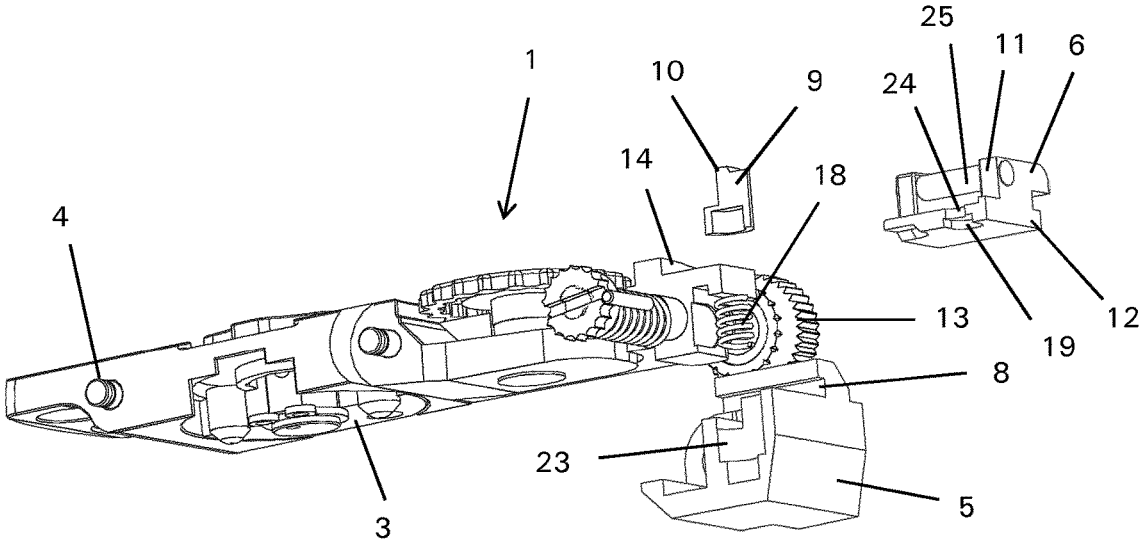
FIG. 6 is an exploded view of the sight arm according to FIG. 5, showing partially cut-out components.

A modified embodiment of a sight device 1 according to the invention is shown in FIGS. 5 and 6, in which only the sight arm 3 is shown (base 2 is not shown).

In its essential parts, the sight device shown in FIGS. 5 and 6 is constructed like the sight device shown in FIGS. 1-4, and their parts interact in the same way. In this respect, reference may be made to the above description, e.g., to avoid repetition.

The essential difference between the sight device 1, as shown in FIGS. 5 and 6, and the sight device 1 according to FIGS. 1-4 is, above all, the way in which the locking of the sighting piece 6 is formed on the rear sight slide 5. Again, a latch piece 9 is used for this purpose. As for this embodiment, however, this is not arranged in a latch receiver 15 accessible from the rear side of the rear sight slide, but in a latch receiver 23 formed in the rear sight slide 5, whereby it is accessible only from an upper side of the rear sight slide 5, i.e., the latch piece 9 is only accessible from there. The latch receiver 23 is formed in the middle of the rear sight slide 5, so to speak, and not at its edge. Furthermore, another rear sight piece 6 is used, which has an opening 24 in a base resting on the upper surface of the rear sight slide 5. This penetration leads into the latch receiver 19 and, with the rear sight piece 6 affixed to the rear sight slide 5, allows the latch piece 9 to be reached and pressed down against the force of the spring 18 by means of, e.g., a pin-shaped tool, thus unlocking the rear sight piece 6. As a result of this embodiment, on the one hand, the latch piece 9 is invisible from the outside of the sight device 1 according to the invention, such that it acts as one piece with the inserted rear sight piece 6, which may be advantageous in terms of the aesthetic effect. Furthermore, with such a solution, it is practically impossible for the latch piece 9 to be accidentally and unintentionally moved, and thus for the rear sight piece 6 to become detached from the rear sight slide 5.

The rear sight 6 shown in FIGS. 5 and 6 here has the aforementioned light guide rods 25, which are aligned parallel to a sighting axis, which may be, e.g., red or yellow transparent Plexiglas rods.

Finally, it should be emphasized at this point that the sight device 1 shown in the above-described exemplary embodiments is intended for retrofitting an existing firearm and, for this purpose, has through-holes 21, which pass through the base 2 and whereby fastening screws can be passed and inserted into corresponding threaded holes in a companion part of the firearm, e.g., a barrel section or a housing part.

REFERENCE NUMERAL LIST

1 sight device
2 Base
3 Sight arm
4 Pivot axis
5 Rear sight slide
6 Rear sight piece
7 receiver
8 Dovetail groove
9 Latch piece
10 Latch section
11 Rear sight
12 Dovetail projection
13 Set screw
14 End face
15 latch receiver
16 Guide slot
17 Guide web
18 Spring
19 Latch receiver
20 Projection
21 Through-hole
22 End face
23 latch receiver
24 Penetration
25 Light guide rod

The invention claimed is:

1. A sight device for a firearm, in particular a handgun, comprising:

a base;

a sight arm;

a rear sight slide; and at least one rear sight piece having a rear sight, wherein the sight arm is fixed to the base in order to be pivotable in a pivot direction relative to the base about a pivot axis extending transversely, in particular perpendicularly, to a sight axis;

wherein the rear sight slide is arranged on the sight arm in a vicinity of a free end of the sight arm and is displaceable transversely to the sight axis, as well as transversely to the pivot direction relative to the sight arm for an adjustment position, and the rear sight slide is fixable on the sight arm in a set adjustment position;

wherein the at least one rear sight piece is detachably fixed on the rear sight slide and in a defined position relative to the rear sight slide;

wherein the rear sight slide on an upper side has a receiver for the rear sight piece, which receiver is open toward an end face of the free end of the sight arm, and has retaining structures into which the rear sight piece is insertable in a direction parallel to the sight axis, and in which the rear sight piece is held in a fixed position on the rear sight slide in the pivot direction and in a direction transverse to the pivot direction, and transverse to the sight axis due to the interaction of the retaining structures with matching structures on the rear sight piece; and wherein a spring-loaded latch piece, which is displaceable in the pivot direction is provided on the rear sight slide, which latch piece comprises a locking section and engages in a locking receiver on the rear sight piece when the rear sight piece is inserted into the receiver.

2. The sight device according to claim 1, wherein the retaining structures on the rear sight slide are formed by two dovetail grooves which run parallel to the sight axis and interact with dovetail projections formed on the rear sight piece as the matching structure.

3. The sight device according to claim 1, wherein the latch piece arranged in a latch receiver formed in the rear sight slide, and is biased by a spring in a direction of an upper side of the rear sight slide into a locking position.

4. The sight device according to claim 3, wherein the latch receiver is formed in the rear sight slide such that the latch piece inserted therein is accessible only via an opening of the latch receiver defined on the upper side of the rear sight slide, and in that the rear sight piece has an opening through which the latch receiver and the latch piece arranged therein are accessible, when the rear sight piece is affixed on the rear sight slide.

5. The sight device according to claim 1, wherein the end face at the free end of the sight arm is a plane end face against which a level bearing surface of the rear sight slide rests and along which the level bearing surface of the rear sight slide slides, when the rear sight slide is displaced relative to the sight arm in order to set the adjustment position, wherein the end surface in the vicinity of the receiver projects beyond a contact surface, such that the end surface forms a stop opposite a side on which the receiver is open for insertion of the rear sight piece, and limits the insertion of the rear sight piece.

6. The sight device according to claim 1, wherein the rear sight slide is displaceable relative to the sight arm by means of a set screw and is affixable in the adjustment position.

7. The sight device according to claim 1, comprising at least two rear sight pieces with differently shaped rear sights.

8. The sight device according to claim 1, wherein the pivot axis extends perpendicularly relative to the sight axis.

9. The sight device according to claim 1, wherein the rear sight slide is displaceable perpendicularly to the sight axis relative to the sight arm for the adjustment position.

10. The sight device according to claim 1, wherein the rear sight slide is displaceable perpendicularly to the pivoting direction relative to the sight arm for the adjustment position.

11. The sight device according to claim 1 formed as an interchangeable sight device for attachment to a firearm and includes an attachment means formed on the base for fixation to the firearm.

12. The sight device according to claim 11, wherein the firearm is a handgun.

* * * * *